US006390017B1

(12) United States Patent
Hendrickson et al.

(10) Patent No.: US 6,390,017 B1
(45) Date of Patent: May 21, 2002

(54) STANDINGS MARKER

(76) Inventors: Fred M. Hendrickson; Linda A. Weidemann-Hendrickson, both of 412 Eighth Ave., Two Harbors, MN (US) 55616

( * ) Notice: Subject to any disclaimer, the term of this patent is extended or adjusted under 35 U.S.C. 154(b) by 0 days.

(21) Appl. No.: 09/575,615

(22) Filed: May 22, 2000

(51) Int. Cl.[7] ..... A63F 1/18; A63F 11/00; G09F 17/00

(52) U.S. Cl. ..... 116/317; 116/173; 116/222

(58) Field of Search ..... 116/316, 317, 116/318, 222, 223, 224, 225, 200, 173, 174, 175, 309

(56) References Cited

U.S. PATENT DOCUMENTS 3,159,136 A * 12/1964 Flnken ..... 116/316
3,292,927 A * 12/1966 Beach ..... 273/148 R
3,315,632 A * 4/1967 Hyden ..... 116/223
3,709,489 A * 1/1973 Holleran et al. ..... 473/446
3,949,506 A 4/1976 Benkowski ..... 40/711
4,019,271 A * 4/1977 Latimer ..... 40/603
4,073,493 A * 2/1978 Moreland ..... 273/148 R
D366,798 S 2/1996 Messersmith ..... D6/571
D369,625 S 5/1996 Nevels ..... D20/42
5,668,782 A * 9/1997 Crawford ..... 368/107
5,766,074 A 6/1998 Cannon et al. ..... 463/16
5,819,457 A 10/1998 Parker ..... 40/657
5,899,167 A * 5/1999 Furman ..... 116/173

* cited by examiner

*Primary Examiner*—Diego Gutierrez
*Assistant Examiner*—R. Alexander Smith
(74) *Attorney, Agent, or Firm*—Richard C. Litman

(57) ABSTRACT

A team standings marker that indicates the standings of teams in an organized league. The standings marker allows a fan to track and display the standings of the teams during the course of a season. The standings marker has an indicia bearing base with a number of small flagpoles supporting team emblem pennants.

9 Claims, 2 Drawing Sheets

STANDINGS MARKER

BACKGROUND OF THE INVENTION

1. Field of the Invention

The present invention relates generally to devices for tracking and displaying the standings of teams in an organized league and more particularly, to a team's standings marker or display. The team's standings marker is a base with a number of small flagpoles supporting team emblem pennants.

2. Description of the Related Art

Every fan is an ardent advocate for his or her team with every fan seeking a way to exhibit his or her enthusiastic support for his or her favorite team. Public displays of team loyalty are commonplace. Sports fan are always looking for new and creative ways to express their devotion to a sport and to a team. The enthusiasm and excitement of following one's favorite team during the course of a season has each fan anxiously awaiting the arrival of every new season.

The prior art describes a variety of devices for displaying the standings of sports teams. For example, U.S. Pat. No. Des. 366,798, issued on Feb. 6, 1996 to R. J. Messersmith, describes an ornamental design for a wall mounted board for a team display of baseball cards. An ornamental design for a data tracking display board is described in U.S. Pat. No. Des. 369,625, issued on May 7, 1996 to L. F. Nevels.

U.S. Pat. No. 3,949,506, issued on Apr. 13, 1976 to J. Benkowski, describes a plaque with repositionable ornamental team units. The ornamental team plaque is made of plastic and has a plurality of ornamental team unit members that are repositionably mounted on the face of the plastic body. The plurality of ornamental team unit members are positioned in a numerical sequence to designate team standing and a date indicator shows the time period for which the standings are valid.

A device and method for displaying a final gaming result is described in U.S. Pat. No. 5,766,074, issued on Jun. 16, 1998 to L. Cannon, et al. In one embodiment, the device and method for displaying a final gaming result displays on a video monitor the winning results in a complete manner and all non-winning results in a faded manner. In an alternate embodiment, only the winning results of the game are displayed. The gaming device includes input devices, memory devices, and output devices, all of which are connected to a central processor.

U.S. Pat. No. 5,819,457, issued on Oct. 13, 1998 to R. J. Parker, describes a sports teams standing apparatus. A support is provided having a generally planar face surface on which a playing field for selected sport is demarked. Respective sets of attachment means, such as a hook members, are placed on loci spaced from one another on the face surface. For each attachment means a team designator is provided for removably mounting on respective attachment means.

None of the above inventions and patents, taken either singularly or in combination, is seen to describe the instant invention as claimed. Thus a standings marker solving the aforementioned problems is desired.

SUMMARY OF THE INVENTION

Accordingly, it is a principal object of the invention to provide a team standings marker or display that decoratively and clearly shows the league standings of teams in a league.

It is another object of the invention to provide a team standings marker that can be easily rearranged or modified to show changes in the standings of the teams.

It is a further object of the invention to provide a team standings marker that can be quickly and easily reduced in size to reflect the withdrawal of a team from the league or increased in size to reflect the addition a new team to the league.

Still another object of the invention is to provide a team standings marker that demonstratively shows the outcome or result of a game between two teams.

It is an object of the invention to provide improved elements and arrangements thereof for the purposes described which is inexpensive, dependable and fully effective in accomplishing its intended purposes.

The foregoing objectives are achieved in accordance with the present invention by providing a modular team standings marker or display that exhibits the standings of teams in an organized league or the outcome of a game between two teams in the league. The team standings marker of the present invention has a two tier base with an indicia bearing lower tier and a team pennant bearing upper tier. The team standings marker can be readily expanded to accommodate new expansion teams.

The team standings marker allows the sportsman to share in the glory when his favorite team wins. The team standings marker can be used to show the standings and the outcome of games for any type of team competition.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
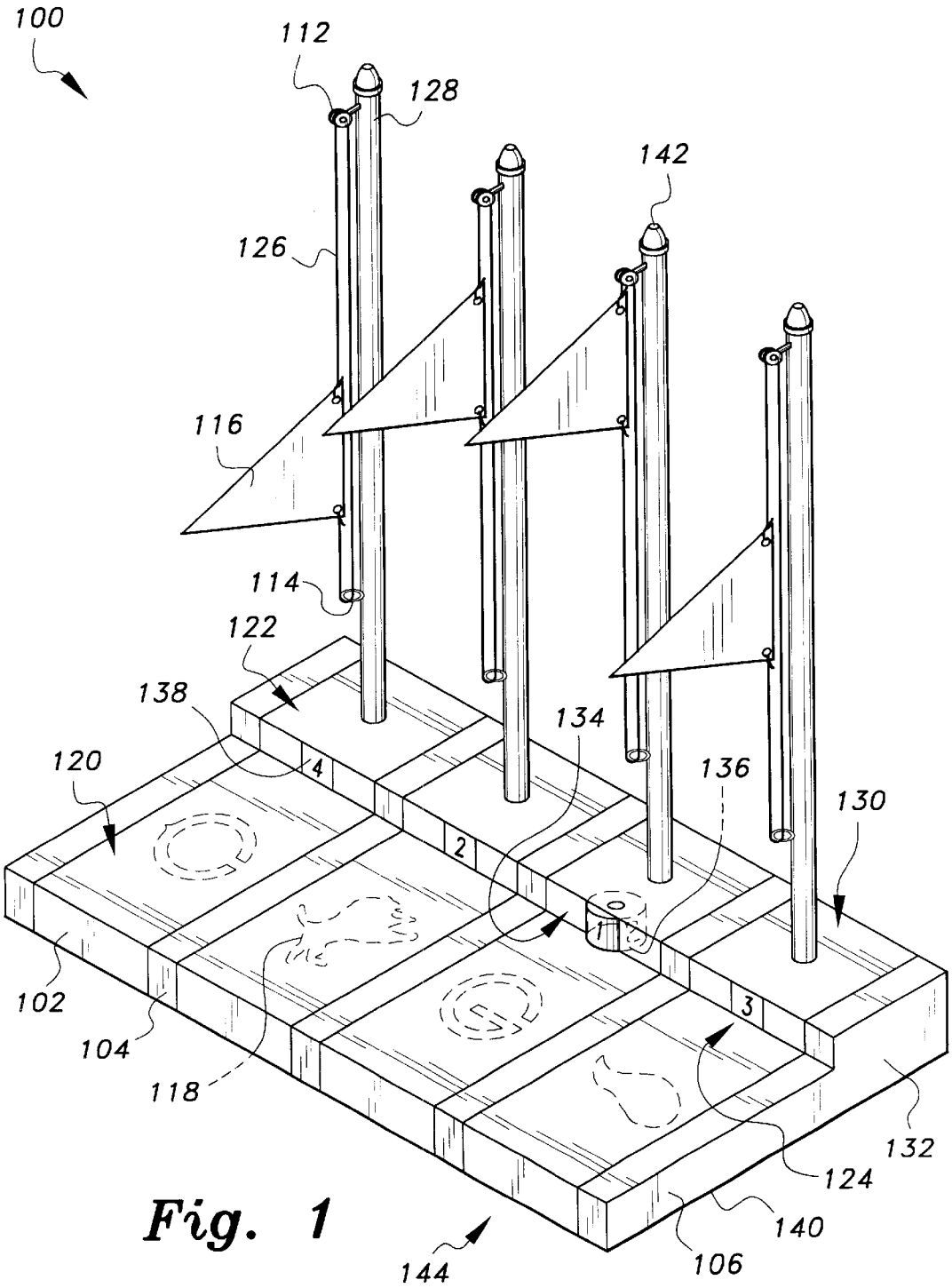
FIG. 1 is an environmental, perspective view of a teams standings marker according to the present invention.
Figure 2:
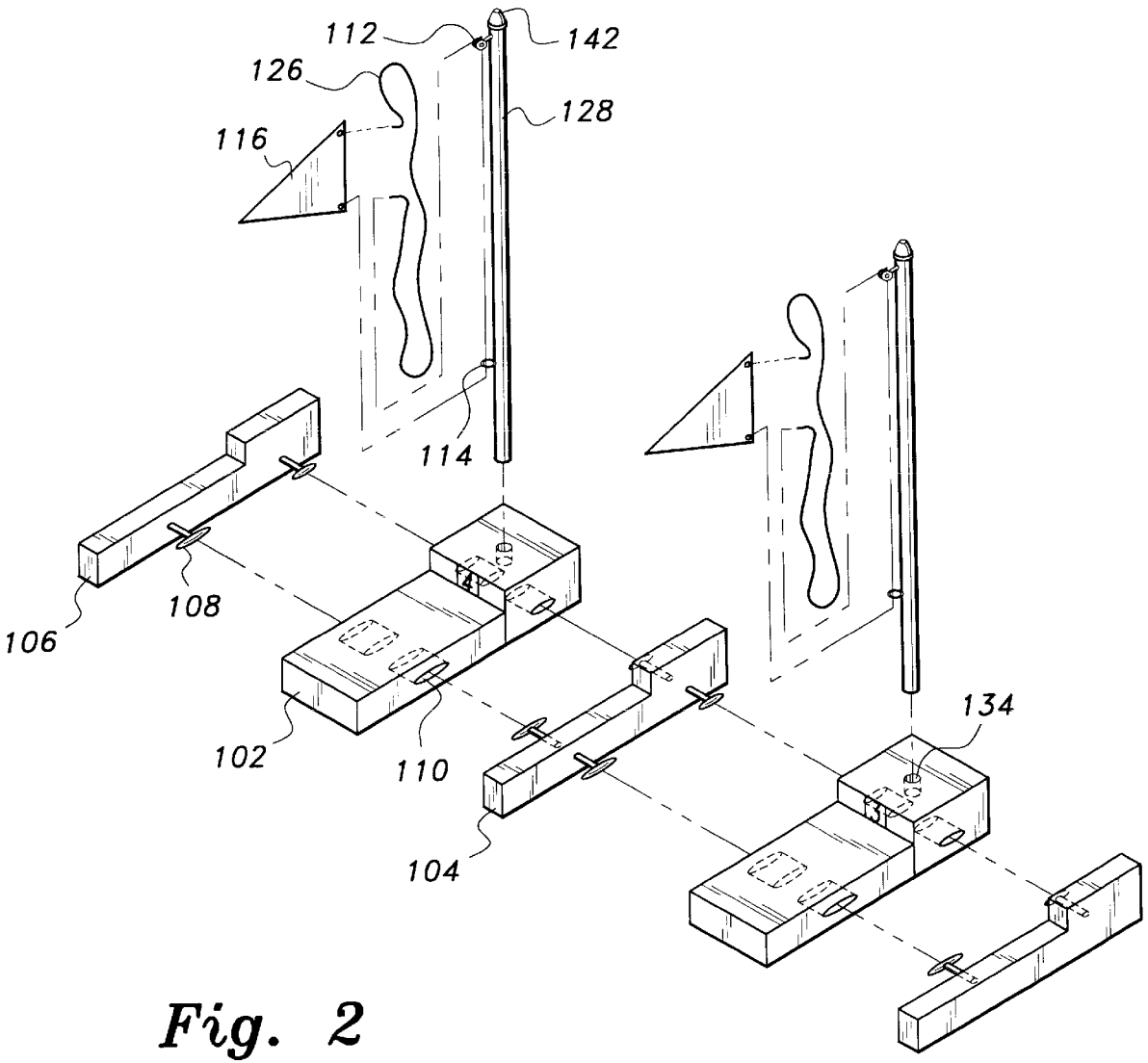
FIG. 2 is an exploded view of a teams standings marker.

The present invention, as depicted in FIGS. 1 and 2, is a team standings marker or display 100 for designating the standings of teams in an organized league or the outcome of a game between two teams in an organized league. The team standings marker 100 has an innovative modular construction that allows the marker or display 100 to be expanded when a new team is added to the league and to be condensed when a team withdraws from the league. FIG. 2 is an exploded view of a teams standings marker 100 showing the component parts of the marker 100. Modular base units 102 serve both a support function and a display function. The modular base units 102 when connected form a support platform 144.

The individual base units 102 have a two tier 120,122 arrangement with the lower tier 120 displaying the logo 118 of a team and with the upper tier 122 supporting a small flag pole or staff 128 that flies a team emblem pennant 116 bearing a team's name and/or logo 118. The flag pole 128 is disposed within an opening 134 in the upper tier's top surface 130. The lower tier 120 has a rectangular shape while the upper tier 122 has a square shape. Furthermore, the surface of the upper tier 122 is the same color as the team's color or colors, for example, the upper tier top surface 130 of one base unit 102 is green while the upper tier top surface 130 for another base unit 102 is purple.

FIG. 1 shows an environmental, perspective view of a fully assembled teams standings marker 100 bearing the team logos 118 and flying the team emblem pennants 116 of several teams. When fully assembled the team standings marker 100 stands approximately 9 inches from the bottom 140 of the platform 144 to the top 142 of the flag pole 128. The relative position of the pennant or flag 116 is changed by means of a pulley arrangement 112,114,126 as shown in FIG. 1. Therefore, a jubilant fan is able to fly his team's pennant 116 at full mast after a win and flies the defeated team's pennant 116 at half mast.

Referring to FIG. 2, spacers 104 with the same two tier 120,122 design as the base units 102 are disposed between the base units 102 to provide spacing between two adjacent base units 102. A pair of end caps 106 also having a two tier arrangement are disposed at each end 132 of the standings marker 100. The base units 102, the spacers 104, and the end caps 106 are connected to each other by inserting T-shaped pins 108 disposed on the sides of the spacers 104 and the end caps 106 into slots 110 disposed on the sides of the base units 102. The end caps 106 have pins 108 disposed only on one side as shown in FIG. 2. Each base unit 102 is 2 inches in width and 6 inches in length, each spacer 104 is ½ inch in width and 6 inches in length, and each end cap 106 is ½ inch in width and 6 inches in length. The base units 102, the spacers 104, and the end caps 106 can be made of any suitable material, such as wood or plastic.

A standings indicator 124 is disposed at the front surface 134 of the upper tier 122 and indicates the standing of the team in the league. The standings indicator 124 can be a dial with numerals 136, a cube with numerals (not shown), an octagon with numerals (not shown), or individual plastic encapsulated paper numerals 138. The team standings marker 100 is also used to show the outcome or result of a game between two teams, for example, the team pennant 116 for the victorious team is flown at full mast while the team pennant 116 for the losing team is flown at half mass with the team pennants 116 for teams that did not play located at the base of the flag pole 128.

The team standings marker of the present invention allows the avid sports fan to savor every minute of a victory with a constant reminder of that joyous moment and to relish in frequently seeing his or her favorite team's standings in the league. The team standings marker can be scaled up or down in size to accommodate the needs of the user, for example, a scaled down team standings marker can easily reside on a sports fan's desk. Thus, the sports enthusiast can have an "at a glance" update of league standings and game results.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated.

It is to be understood that the present invention is not limited to the embodiments described above, but encompasses any and all embodiments within the scope of the following claims.

We claim:

1. A team standings marker comprising:

a plurality of modular base units interconnected in order to define a two tier platform, each said base unit having a lower tier and an upper tier, each said lower tier having a top surface with indicia corresponding to a sport's team logo thereon, each said upper tier having a front surface and a top surface;

a plurality of flag poles, each said base unit having one of said plurality of flag poles mounted on the top surface of the upper tier thereof;

a plurality of team pennants, each of said flag poles supporting one of said team pennants; and a plurality of standings indicators, the front surface of the upper tier of each of said base units having a standings indicator disposed thereon.

2. A team standings marker according to claim 1, wherein each said team pennant has a team logo thereon.

3. A team standings marker according to claim 1, wherein each of said flagpoles has a pulley arrangement mounted thereon for moving said pennant up and down said flagpole.

4. A team standings marker according to claim 1, further comprising at least one spacer having a plurality of pins thereon, each of said base units having a pair of side surfaces with a plurality of holes defined therein, said base units being interconnected by placing said spacer between said adjacent base units and inserting the pins into the holes defined in said base units.

5. A team standings marker according to claim 1, further comprising a pair of end caps, said end caps being attached to opposite sides of said two tier platform.

6. A team standings marker according to claim 1, wherein each of said standings indicators comprises a dial with numerals.

7. A team standings marker according to claim 1, wherein said standings marker has a height of 9 inches.

8. A team standings marker according to claim 1, wherein said platform is made of wood.

9. A team standings marker according to claim 8, wherein said platform is made of plastic.

* * * * *